US008192224B2

(12) United States Patent
Schmidt et al.

(10) Patent No.: US 8,192,224 B2
(45) Date of Patent: Jun. 5, 2012

(54) ELECTRICAL PLUG CONNECTOR WITH STRAND GUIDE

(75) Inventors: Ralf Schmidt, Furth (DE); Martin Szelag, Bickenbach (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/129,380

(22) PCT Filed: Nov. 4, 2009

(86) PCT No.: PCT/EP2009/064631

§ 371 (c)(1), (2), (4) Date: May 13, 2011

(87) PCT Pub. No.: WO2010/054972

PCT Pub. Date: May 20, 2010

(65) Prior Publication Data

US 2011/0212652 A1 Sep. 1, 2011

(30) Foreign Application Priority Data

Nov. 15, 2008 (DE) ..... 10 2008 057 554

(51) Int. Cl.
*H01R 11/20* (2006.01)

(52) U.S. Cl. ..... 439/409

(58) Field of Classification Search ..... 439/409, 439/417, 676, 941, 344
See application file for complete search history.

(56) References Cited

U.S. PATENT DOCUMENTS

| | | | | |
|---|---|---|---|---|
| 4,501,459 | A | 2/1985 | Chandler et al. | |
| RE32,760 | E | 10/1988 | Chandler et al. | |
| 5,206,098 | A * | 4/1993 | Cho et al. | 429/96 |
| 5,947,761 | A * | 9/1999 | Pepe | 439/409 |
| 6,045,398 | A * | 4/2000 | Narita et al. | 439/500 |
| 6,752,647 | B1 | 6/2004 | Lin | |
| 6,887,094 | B2 * | 5/2005 | Boeck et al. | 439/417 |
| 7,134,904 | B2 * | 11/2006 | Bergner et al. | 439/410 |
| 7,572,140 | B2 * | 8/2009 | Szelag et al. | 439/405 |
| 2005/0124206 | A1 | 6/2005 | Bergner | |
| 2008/0268718 | A1 | 10/2008 | Cox et al. | |

(Continued)

FOREIGN PATENT DOCUMENTS

DE 10 2004 038 123 B4 2/2006

(Continued)

OTHER PUBLICATIONS

International Search Report and Written Opinion issued by the European Patent Office, dated Jan. 25, 2010 for PCT/EP2009/064631; 14 pages.

(Continued)

*Primary Examiner* — Tulsidas C Patel
*Assistant Examiner* — Phuongchi Nguyen
(74) *Attorney, Agent, or Firm* — Faegre Baker Daniels LLP

(57) ABSTRACT

The invention relates to an electrical plug connector (1) for an electrical cable (2), with a strand guide (10) which is provided on the electrical plug connector (1) so as to be able to move, wherein the strand guide (10) or the electrical plug connector (1) has a release means (112, 212) which can be used to separate the strand guide (10) from the electrical plug connector (1). The invention further relates to a manufactured electrical cable with an electrical plug connector (1) according to the invention; and also to an electrical or electronic apparatus or component, with an electrical plug connector (1) according to the invention or a manufactured electrical cable according to the invention.

20 Claims, 9 Drawing Sheets

U.S. PATENT DOCUMENTS

| | | | | |
|---|---|---|---|---|
| 2009/0153128 | A1* | 6/2009 | Yu | 323/358 |
| 2009/0305543 | A1* | 12/2009 | Boeck et al. | 439/344 |
| 2011/0212652 | A1* | 9/2011 | Schmidt et al. | 439/660 |

FOREIGN PATENT DOCUMENTS

| | | | |
|---|---|---|---|
| EP | 1624534 | A2 | 2/2006 |
| FR | 2815781 | | 4/2002 |
| WO | WO 99/65112 | A1 | 12/1999 |
| WO | WO 02/15340 | A1 | 2/2002 |

OTHER PUBLICATIONS

Search Report issued by the German Patent and Trademark Office, dated Jul. 24, 2009, for Priority Application No. 10 2008 057 554.2-34; 2 pages.

International Preliminary Report on Patentability, dated May 17, 2011, issued by the International Bureau of WIPO, Geneva, Switzerland, for PCT/EP2009/064631; 8 pages.

* cited by examiner

ELECTRICAL PLUG CONNECTOR WITH STRAND GUIDE

BACKGROND OF THE INVENTION

The invention relates to an electrical plug connector for an electrical cable, with a strand guide which is provided on the electrical plug connector so as to be able to move. The invention further relates to a manufactured electrical cable with an electrical plug connector according to the invention; and also to an electrical or electronic apparatus or component, with an electrical plug connector according to the invention or a manufactured electrical cable according to the invention.

Owing to increasing miniaturisation of electrical interfaces, in particular in the field of electronics, respective electrical plug connectors—which may be embodied for example as stud, socket, coupling, spring, pin, modular, RJ plug connectors, etc. —must also become smaller. This entails problems in the manufacturing of an electrical cables with a plug connector of this type, as the individual strands of the cable must be introduced into corresponding means within the plug connector that are in this case also becoming smaller and smaller. In particular, the miniaturisation results in electrical contact and/or short-circuit problems, as it repeatedly occurs that strands cannot be properly accommodated in the plug connector.

In order to facilitate electrical contacting of the cable with the corresponding electrical lines within the plug connector, strand guides are known into which the individual strands of the electrical cable are introduced into contact means provided therefor of the strand guides. Subsequently, the strand guide is brought into a correct position on/in the electrical plug connector. In this case, there is usually carried out at the same time electrical contacting of the strands with the respective lines of the plug connector within the strand guide which has appropriate recesses for this purpose. This is carried out usually by means of insulation displacement contacts arranged in the plug connector.

Loose strand guides are in this case known, which are first fitted with the strands, the strand guide subsequently being configured in the plug connector. Kits or connection sets consisting of a plurality of parts are commercially available for this purpose, the loose and thus losable strand guides being attached to the electrical plug connectors. The strand guides and the plug connectors are joined together for the first time by the user for the cable connection. Captive strand guides are also known, which are connected to the respective plug connector non-releasably but pivotably.

U.S. Pat. No. 7,134,904 B2 discloses an electrical terminal unit with a strand guide which can be inserted into a trough-shaped housing of the terminal unit in a substantially translatory manner from above. A pivotable cover, which can be used to permanently secure the strand guide in the housing, is located on the housing of the terminal unit. In this case, the strand guide is provided, in an open position of the cover, at all times loosely in the housing, i.e. connected thereto non-securely and non-pivotably.

DE 603 10 002 T2 discloses a shielded electrical connecting arrangement for data transfer, for example for producing electrical contacts with an Ethernet cable. In this case, a floating strand guide, which can move in translation and rotation, is provided separately from a housing and a covering cap of the connecting arrangement. The floating strand guide is loosely inserted, with an electrical cable fitted thereto, into the housing and entrained by the covering cap which is provided on the housing so as to be able to pivot. As a result, insulation displacement contacts provided on a printed circuit board are electrically contacted by strands of the cable. Problems here include the fact that the strand guide can slip out of the housing during pivoting of the covering cap or—in order to prevent this—an additional fitting step must be provided.

DE 10 2004 038 123 B4 discloses an electrical plug connector with a pivotable strand guide, the strand guide being non-releasably connected to the plug connector. That is to say, the strand guide cannot be detached from the plug connector without complex taking-apart of the plug connector by means of a tool. This results in particular in problems for fitting an electrical cable to the plug connector and vice versa. In order to remove the strand guide, it is at least necessary to remove a housing part of the plug connector. Electrical contacting of the strands of a cable provided on the strand guide is carried out during pivoting of the strand guide into the plug connector, insulation displacement contacts located in the plug connector cutting open a respective electrical insulation of the strands of the cable.

SUMMARY OF THE INVENTION

An object of the invention is to disclose an improved electrical plug connector for an electrical cable. A further object of the invention is to disclose a manufactured electrical cable, an electrical and/or electronic apparatus or component, with an electrical plug connector improved in accordance with the invention. This should allow safer and more rapid fitting of the plug connector according to the invention to a cable. Furthermore, the handling of the strand guide of the plug connector should be simplified and the plug connector should have roughly the same level of cost as a conventional electrical plug connector.

The electrical plug connector according to the invention should have in this case a strand guide which can on the one hand—for example for a dispatch state of the plug connector—be captively connected to the plug connector, but on the other hand should be able to be removed out of/from the plug connector, so that handling thereof is facilitated for manufacturing an electrical cable. The latter aspect should be provided merely as an option, so that the plug connector according to the invention may continue to be handled in the conventional manner. Furthermore, the strand guide is to have a defined electrical contact and mechanical removal position on/in the plug connector. In addition, a preferably individual colour coding of all the poles of the strand guide is to be possible in accordance with the invention.

The object of the invention is achieved by means of an electrical plug connector for an electrical cable, according to claim 1; a manufactured electrical cable with an electrical plug connector according to the invention, according to claim 11; and an electrical or electronic apparatus or component, with an electrical plug connector according to the invention or a manufactured electrical cable according to the invention, according to claim 12. Advantageous developments of the invention emerge from the dependent claims.

An electrical plug connector according to the invention for an electrical cable has a strand guide which is provided on the plug connector so as to be able to move. The strand guide or the plug connector has a release means in such a way that the strand guide can be removed from the electrical plug connector by actuating the release means. In this case, the strand guide is provided, in a fitting position on/in the plug connector, so as to be able to move but securely connected thereto. Starting from the fitting position on/in the plug connector, the strand guide can be separated from the plug connector by triggering the release means for a removal position.

In other words, in the fitting position, the strand guide is arranged so as to be able to move on/in the remainder of the plug connector, but nevertheless connected captively thereto; the strand guide thus has a certain degree of freedom in relation to the remainder of the electrical plug connector. Preferably, the strand guide has just a single degree of freedom in relation to the plug connector, which is preferably a degree of rotatory freedom. In this case, it is sufficient if the strand guide is rotatable through at most approx. 90° in relation to the remainder of the plug connector. Larger or smaller maximum angles of movement may of course be used.

Such a mechanism according to the invention for rapidly separating the strand guide from the electrical plug connector offers advantages in plug connectors, which have now become very small, with regard to cable fitting, in particular in the case of many individual strands of an electrical cable, and in relation to wastage during the cable fitting. In particular, the strand guide can be provided captively on the plug connector according to the invention; this is advantageous for dispatching and handling of the plug connector.

Should a strand guide become damaged for example during electrical contacting, then it is possible to use a second strand guide for the same plug connector as a replacement part. This is not the case in electrical plug connectors with permanently captive strand guides; in plug connectors of this type, the entire plug connector is always waste. Those plug connectors which have a permanently losable strand guide are not as simple to operate as the invention, in particular as far as electrical contacting of the individual strands of the electrical cable is concerned, and have the drawback of permanent losability of the strand guides.

In one embodiment of the invention, the strand guide is provided on/in the electrical plug connector so as to be able to pivot, in particular directly in relation to a housing part of the plug connector. This is carried out preferably by way of a suitable arrangement of bearings, such as for example a pivot bearing. In accordance with the invention, one bearing partner of the arrangement of bearings is then provided—for example, in the case of a pivot bearing, a bearing journal or a bearing shell—on/in the strand guide or the plug connector so as to be able to move by means of the release means according to the invention in such a way that this bearing partner can be moved away from a different bearing partner—for example a corresponding bearing shell or a corresponding bearing journal. Movability of the former bearing partner is provided preferably by means of an elastically deformable fixed bearing; that is to say, this bearing partner may be provided for example on a resilient leg or a resilient tab.

The removal option according to the invention now allows, in captive strand guides, a side of the strand guide that is in fact concealed to be used for an additional coding, in particular a colour coding. On the one hand, it is in this case possible to individualise the coding; on the other hand, the movability, in particular the pivotability, of the strand guide ensures that the concealed side of the strand guide can be made visible.

In a preferred embodiment of the invention, the release means is a slot allowing one bearing partner to be moved away from the respective other bearing partner. In this case, care must be taken in certain embodiments of the invention to ensure that the slot is, at the level of the bearing partners, at least as wide as a bearing partner must be moved away over a certain distance so that this bearing partner can be removed from the other bearing partner. In this case, it is preferable for the bearing partner which can be moved away to carry out a substantially linear or only slightly curved movement. Preferably, one bearing journal or one bearing shell of a pivot bearing arrangement can be moved away, by means of the slot, from a bearing shell corresponding thereto or a bearing journal corresponding thereto.

In preferred embodiments of the invention, the slot is what is known as a spring slot in the strand guide, which extends from a bearing head of the strand guide in a longitudinal direction of the strand guide. The term "bearing head" refers in this case to that region which can be used to mount the strand guide on/in the electrical plug connector. The spring slot is in this case preferably a continuous slot which extends sufficiently far back into the strand guide as to allow one or both resulting spring legs of the strand guide to be moved in such a way that the strand guide can be removed from its arrangement of bearings in the plug connector and the spring legs also spring back again into their starting position.

This allows the strand guide to be rapidly and simply separated from the plug connector and refitted thereto by means of a mechanism which can be operated using just two human fingers; the invention therefore saves the user time and makes it easier for him to operate the electrical plug connector. In accordance with the invention, it is not necessary to remove a component in order to remove the strand guide from the plug connector which can, in addition, also be removed from the plug connector without a tool.

Instead of a substantially central spring slot in the strand guide, a lateral, movable tab on the strand guide or the plug connector is also possible, the bearing partner which can be moved away being provided on the tab. Preferably, the plug connector has two bearing shells and the strand guide has two bearing journals which correspond thereto and define a pivot axis. This may however also be kinematically inverted or mixed.

In preferred embodiments of the invention, the strand guide, which is fitted to the electrical plug connector, has two defined locking positions. In a contact position, the strand guide is locked to a strain relief metal sheet or a housing part of the plug connector, wherein the electrical cable can be electrically contacted by the plug connector. In an open position, the strand guide is also locked to the strain relief metal sheet or the housing part of the plug connector, wherein the cable cannot be electrically contacted by the plug connector.

The respective locking of the strand guide to the strain relief metal sheet or the housing part of the electrical plug connector is carried out in this case at different points on the strand guide or the remainder of the plug connector. Preferably, the respective locking means are positioned opposite the strand guide in the longitudinal direction of the strand guide. That is to say, for example, that the locking means for the open position is located preferably on the bearing head, and the locking means for the open position is located preferably at that side of the strand guide at which the strands of the cable enter the strand guide.

BREIF DESCRIPTION OF THE DRAWINGS

The invention will be described hereinafter in greater detail based on exemplary embodiments and with reference to the appended drawings, in which.

DETAILED DESCRIPTION OF THE DRAWINGS

The invention will be described hereinafter in greater detail based on two exemplary embodiments of an eight-pole electrical pin plug connector (RJ-45) for telecommunications and network connections. However, the invention is not to be limited to embodiments of this type, but may be applied to all single or multiple-pole electrical plug connectors. This relates in particular to industry and also air, space, water, rail and land vehicles. Furthermore, all references hereinafter to a "strand guide" shall encompass on the one hand the term "wire guiding" and on the other hand the terms "wire guide" or "pivot" which has now also become common currency.

The first embodiment of the invention and also a fitting according to the invention of an electrical cable to an electrical plug connector according to the invention will be described hereinafter in greater detail with reference to FIGS. 1 to 9. The problem to be solved in this case is the fact that, as a result of shield contacting and a simultaneous strain relief function of a strain relief metal sheet of the plug connector, introduction of strands of the cable is possible only with difficulty owing to the multiple-pole plug connector embodiment in the prior art.

Figure 1:
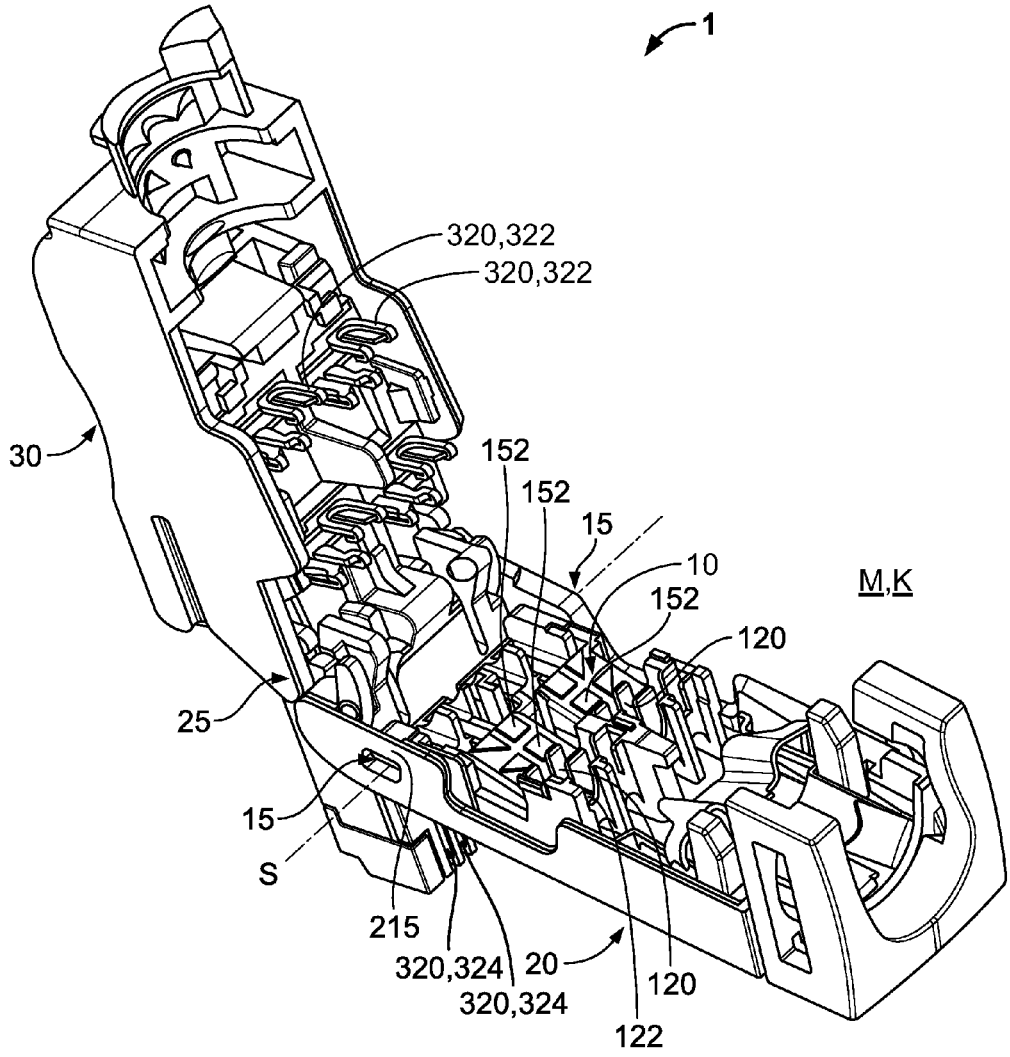
FIG. 1 is a perspective view onto a first embodiment of an opened electrical plug connector according to the invention with a strand guide in a fitting position and a contact position.

FIG. 1 (see also FIGS. 2 to 8) shows a plug connector 1 according to the invention, which is embodied as an electrical pin plug connector 1, in the opened state. The plug connector 1 comprises in this case substantially three components, namely two housing parts 20, 30 which are embodied as a housing lower part 20 and a housing upper part 30, the housing upper part 30 being pivotably mounted on the housing lower part 20, and a strand guide 10 according to the invention which is also mounted in an articulated manner on the housing lower part 20.

In the present case, both the strand guide 10 and the housing upper part 30 are provided on the housing lower part 20 so as to be able to pivot via in each case an arrangement of bearings 15, 25, wherein the two pivot axes do not lie coaxially. Other embodiments are of course possible. Thus, the two pivot axes may coincide or the strand guide 10 be articulated to the housing upper part 30.

The housing upper part 30 has electrical lines 320 which serve for an electrical contact, electrical transmission and electrical contacting with a mating plug (not shown in the drawings), for example a socket. For electrical contacting of strands 3 of an electrical cable 2 (see FIG. 4, 5), the housing upper part 30 preferably has insulation displacement contacts 322 which can be used to electrically contact the strands 3 located in the strand guide 10 in contact means 120.

The insulation displacement contacts 322 are connected in an electrically conductive manner to electrical contacts 324 which in the present case are embodied as onward-contacting pin contacts 324. Other possibilities for electrical contacting, for example as a result of a press contact after prior stripping of the strands 3, or possibilities for onward contacting may of course be used.

FIG. 1 shows a fitting position M of the strand guide 10 according to the invention on/in the electrical plug connector 1, the strand guide 10 itself being shown in its contact position K. That is to say, in the contact position K, strands 3 located in the strand guide 10 can be electrically contacted by the housing upper part 30 by means of insulation displacement contacts 322 thereof. For this purpose, the strand guide 10 has corresponding recesses. An upper coding 152, in particular colour coding 152, for the cable 2, which is in the present case embodied as an eight-pole cable 2, may also be seen in FIG. 1.

The strand guide 10 is secured, while the plug connector 1 is folded open from its delivery state into the position shown in FIG. 1, in this contact position K—what is known as a retaining function of the electrical plug connector 1—so that the strand guide 10 does not pivot in conjunction with the housing upper part 30 and the strands 3 do not become stuck in the insulation displacement contacts 322.

For this purpose, the strand guide 10 and the housing lower part 20, or the strain relief metal sheet 220 thereof (see FIG. 7), have mutually corresponding means for locking, only one locking recess 132 at a rear and lower side of the strand guide 10 being shown in the drawings. The housing lower part 20, or the strain relief metal sheet 220 thereof, then has a locking projection at a corresponding point. In principle, the locking means may be in any desired position, provided that a lock can be formed for the contact position K.

Figure 2:
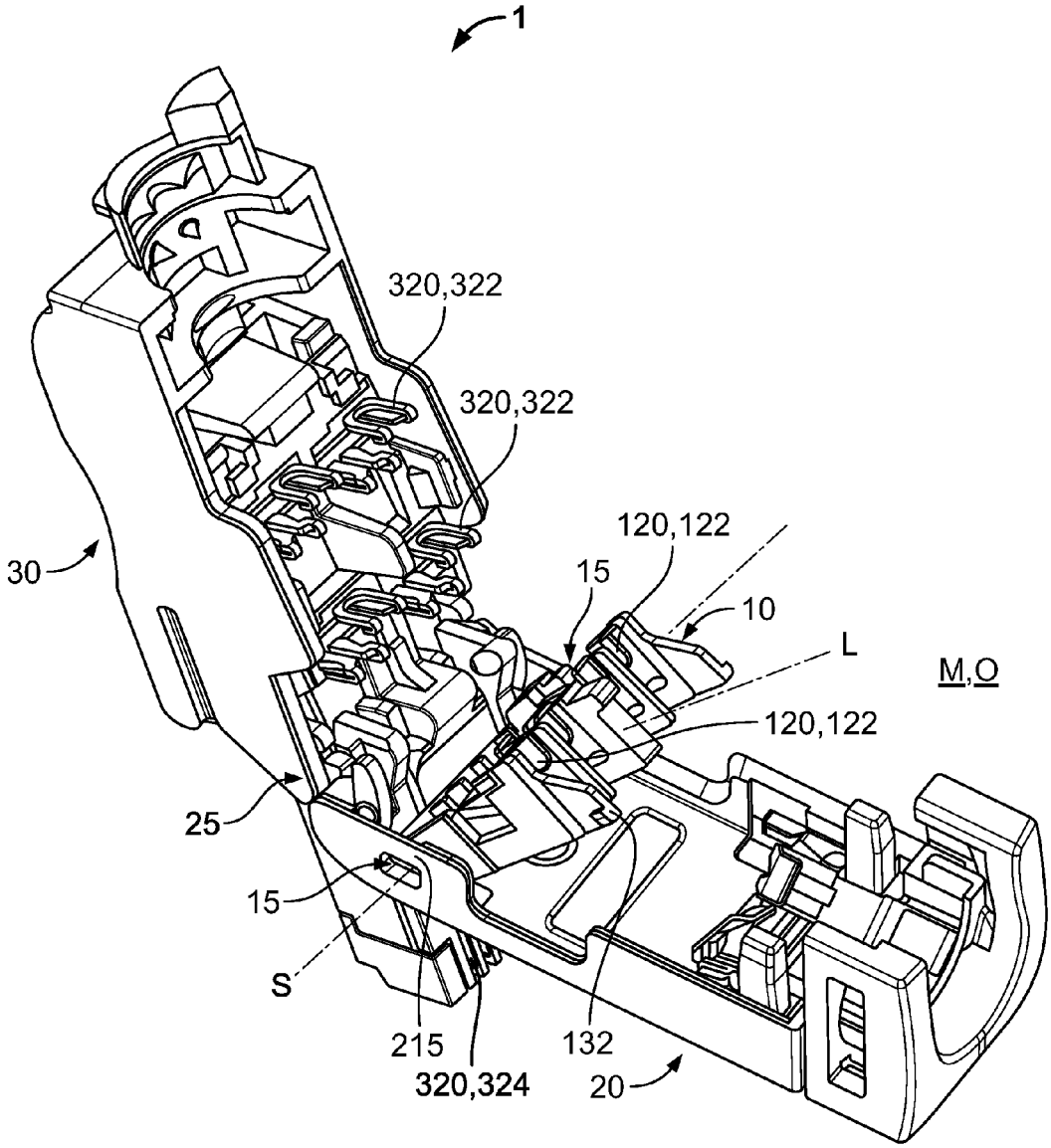
FIG. 2 is a perspective view of the plug connector from FIG. 1, the strand guide according to the invention being shown in the fitting position and an open position.

For fitting of the electrical cable 2 to the electrical plug connector 1, the locking of the strand guide 10 to the strain relief metal sheet 220 or the housing lower part 20 is released, and the strand guide 10 is pivoted into its open position O shown in FIG. 2. In this upwardly pivoted open position O, the strand guide 10 is also preferably locked to the housing lower part 20 or the strain relief metal sheet 220. This may clearly be seen in FIG. 9, a means 134 of the strand guide 10 being locked to a means 234 of the housing lower part 20 or the strain relief metal sheet 220. Preferably, these are a locking shoulder 134 of the strand guide 10 and a locking lug 234 of the housing lower part 20 or the strain relief metal sheet 220. In principle, the locking means may, again, be in any desired position, provided that a lock can be formed for the open position O.

The upward pivoting of the strand guide 10 allows introduction openings 122 of the contact means 120 of the strand guide 10 to be inspected and operated more effectively; the locking position of the strand guide 10 on/in the electrical plug connector 1 additionally improves operation. Furthermore, an additional lower coding 154, in particular colour coding 154, may be made visible (see also FIG. 6).

Now, in accordance with the invention, there are two possibilities for electrically contacting the cable 2 with its strands 3 by way of the plug connector 1. Either the strand guide 10 remains in the electrical plug connector 1 or it is separated therefrom.

Figure 5:
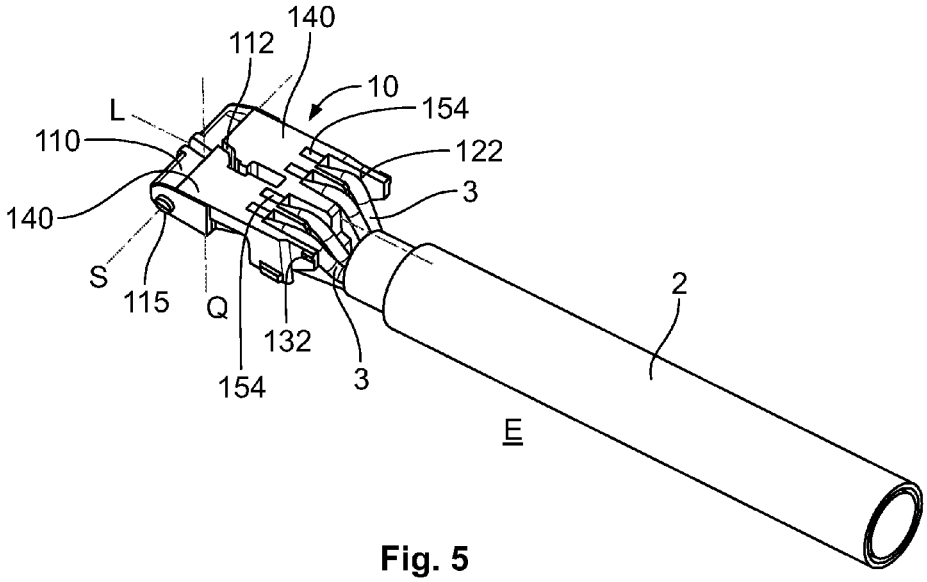
FIG. 5 is a view which is similar to FIG. 4 but which shows the cable from below.
Figure 6:
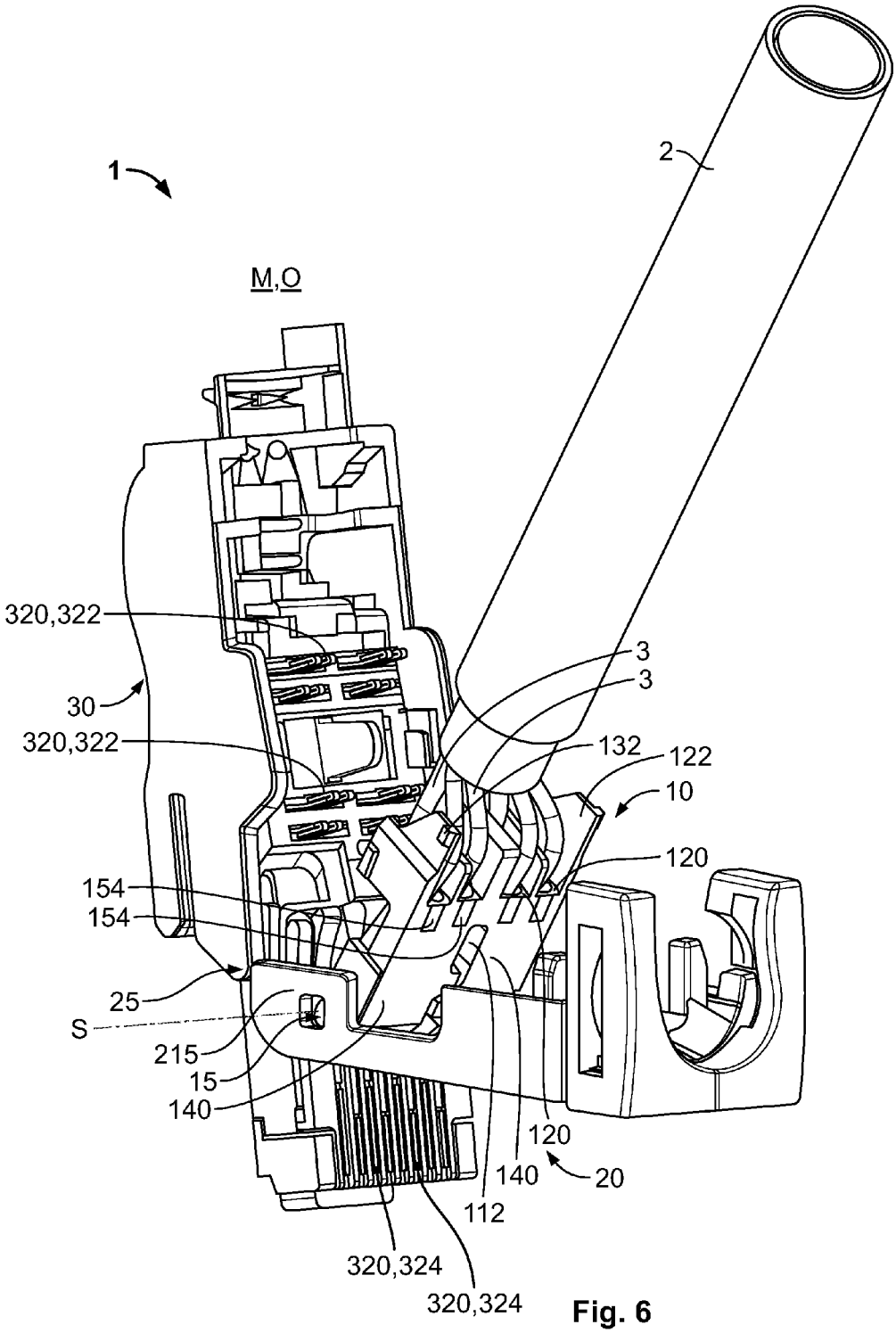
FIG. 6 is a perspective view during fitting of the cable from FIGS. 4 and 5 on/in the plug connector according to FIG. 1, the strand guide being shown in the fitting position and the open position.

If the strand guide 10 remains in the electrical plug connector 1, then a fitted position of the cable 2 to the strand guide 10 is shown in FIG. 6. In this case, the strands 3 are advanced into the contact means 120 of the strand guide 10 through the introduction openings 122. This fitting step is similar to that which will be described hereinafter in greater detail with reference to FIGS. 4 and 5.

Figure 3:
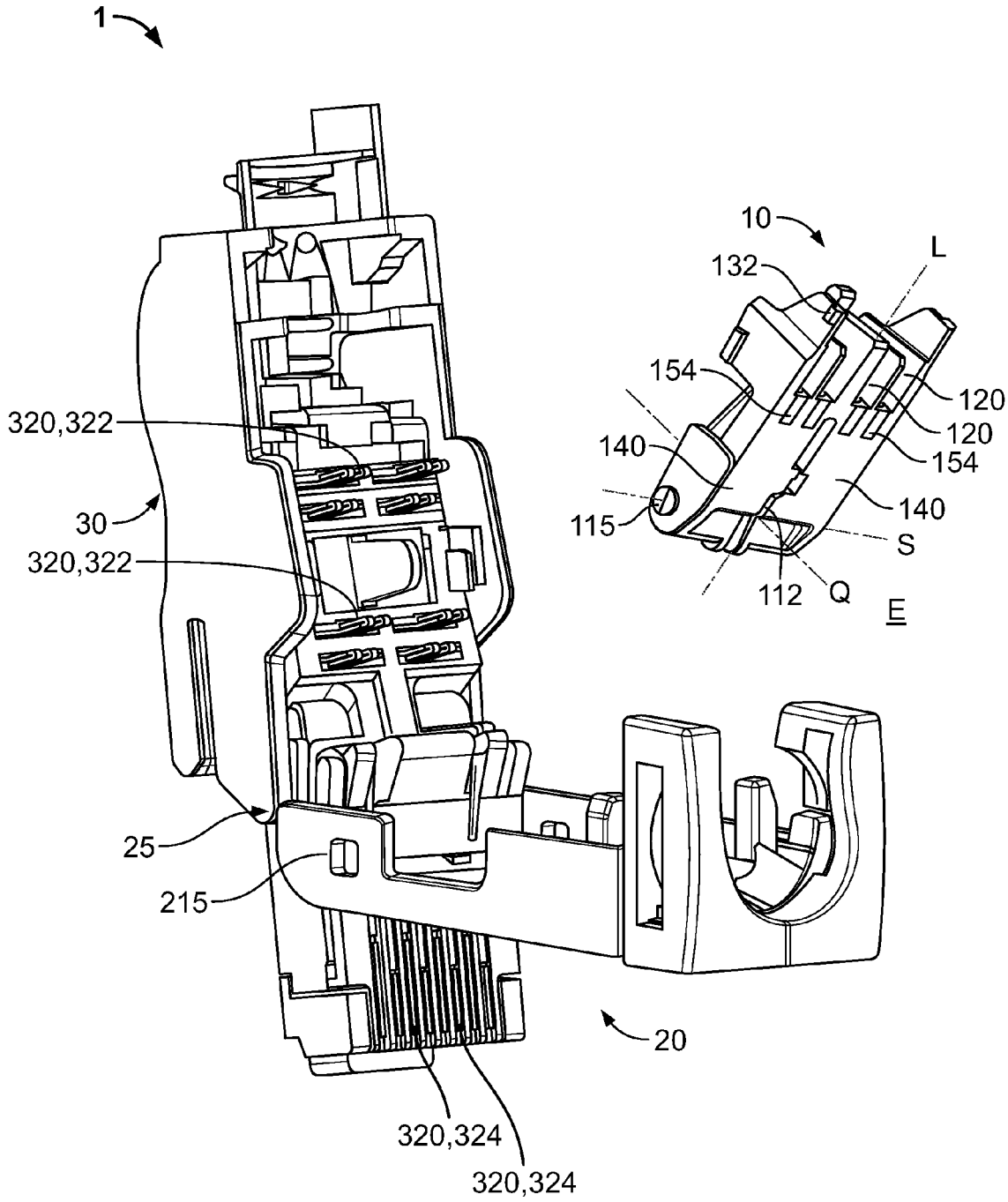
FIG. 3 is a somewhat more lateral perspective view of the plug connector from FIG. 1, the strand guide being shown in the removal position.

In accordance with the invention, there is the option of separating the strand guide 10 from the electrical plug connector 1; this is illustrated in FIG. 3. In order to remove the strand guide 10 from the plug connector 1, the strand guide has a release means 112, preferably a spring slot 112, allowing the strand guide 10 to be separated from the plug connector 1. The spring slot 112 (see also FIG. 8) is in this case provided, starting from a bearing head 110 of the strand guide 10, so as to protrude backward into the strand guide 10 in the longitudinal direction L thereof.

In this case, the spring slot 112 extends into the strand guide 10 roughly up to the centre or to slightly beyond the centre. Other lengths of the spring slot 112 may of course be applied, provided that on the one hand the strand guide 10 does not lose its structural integrity and on the other hand sufficient movability of the resulting resilient legs 140, referred to hereinafter as the spring legs 140, is ensured. Furthermore, the spring slot 112 is provided so as to pass right through the strand guide 10 in a transverse direction Q thereof.

In accordance with the invention, the spring slot 112 produces two spring legs 140 which, when pressed together, allow the strand guide 10 to be removed from the electrical plug connector 1 or to be reinserted into the plug connector 1. During removal of the strand guide 10 from the housing lower part 20, two bearing journals 115 of the strand guide 10 disengage, in the illustrated embodiment of the invention, from corresponding bearing shells 215 of the housing lower part 20. The opposite occurs during insertion of the strand guide 10 into the housing lower part 20.

Each bearing journal 115—also referred to as the bearing partner 115—and each respective bearing shell 215—also referred to as the bearing partner 215—form in this case a respective arrangement of bearings 15 of the strand guide 10 on/in the housing lower part 20. In this case, the arrangement of bearings 15 is embodied as a pivot bearing arrangement 15, the pivot axis S of which is defined by the bearing partners 115, 215. It is of course also possible to use other bearing partners 115, 215 which form a general arrangement of bearings 15, in particular a pivot bearing arrangement 15. Thus, it is for example not necessary—as illustrated in the drawings—to completely close the bearing shells 215 at their circumference. A pan-shaped configuration of the bearing shells 215 is for example also possible.

In accordance with the invention, it is possible to form the spring slot 112 not centrally in the strand guide 10, but rather more laterally, so that then a bearing partner 115 of the strand guide 10 is embodied on a resilient tab (not shown in the drawings). Furthermore, it is also possible to swap over the rolls of the bearing journal 115 and bearing shells 215 only on one side.

Figure 4:
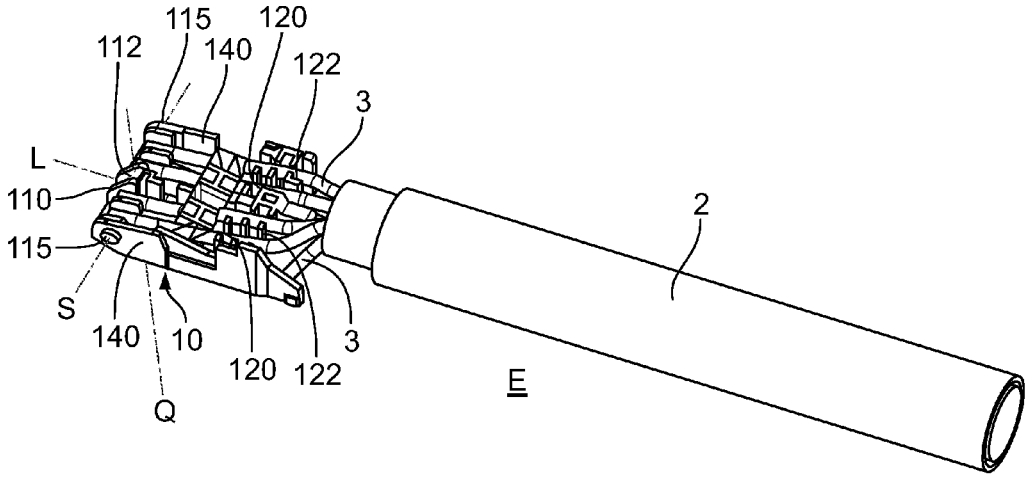
FIG. 4 is a three-dimensional plan view of an electrical cable, the strand guide according to the invention from FIG. 1 being provided on the cable.

Now, FIGS. 4 and 5 also show, like FIG. 6, the strand guide 10 in its removal position E. However, in addition, FIGS. 4 and 5 show the electrical cable 2 provided on the strand guide 10. In this case, in two planes, four respective strands 3 of the eight-core cable 2 are received with their longitudinal end portions in the strand guide 10, each longitudinal end portions of the strand 3 being located in a contact means 120 of the strand guide 10. In this case, it is for example possible to plug the longitudinal end portions of the strand 3, coming from an outside, into the contact means 120 which are open in the longitudinal direction L (FIG. 4, upper strands 3, with reference to FIG. 4) or to advance them into the strand guide 10 through the introduction openings 122 (FIG. 5, upper strands 3 with reference to FIG. 5).

In accordance with the invention, the longitudinal end portions of the strands 3 of the electrical cable 2 can also be introduced or inserted, based on the removal option of the strand guide 10, outside the electrical plug connector 1. In this case, it is possible to shorten the longitudinal end portions of the strands 3 accordingly by means of a tool only after the introduction or insertion thereof; this would not be possible with a captively arranged strand guide 10.

After fitting of the strand guide 10 to the electrical cable 2, the strand guide 10 is—as indicated hereinbefore—advanced, after pressing-together of the two leg springs 140 with the bearing head 110 of the strand guide, into the region between the bearing shells 215 of the housing lower part 20. After releasing of the two leg springs 140, the bearing journals 115 of the strand guide 10 enter the bearing shells 215 of the housing lower part 20, the strand guide 10 being, again, pivotably connected to the electrical plug connector 1; the strand guide 10 is in the fitting position M and, again, in its open position O; this is shown in FIG. 6.

Figure 7:
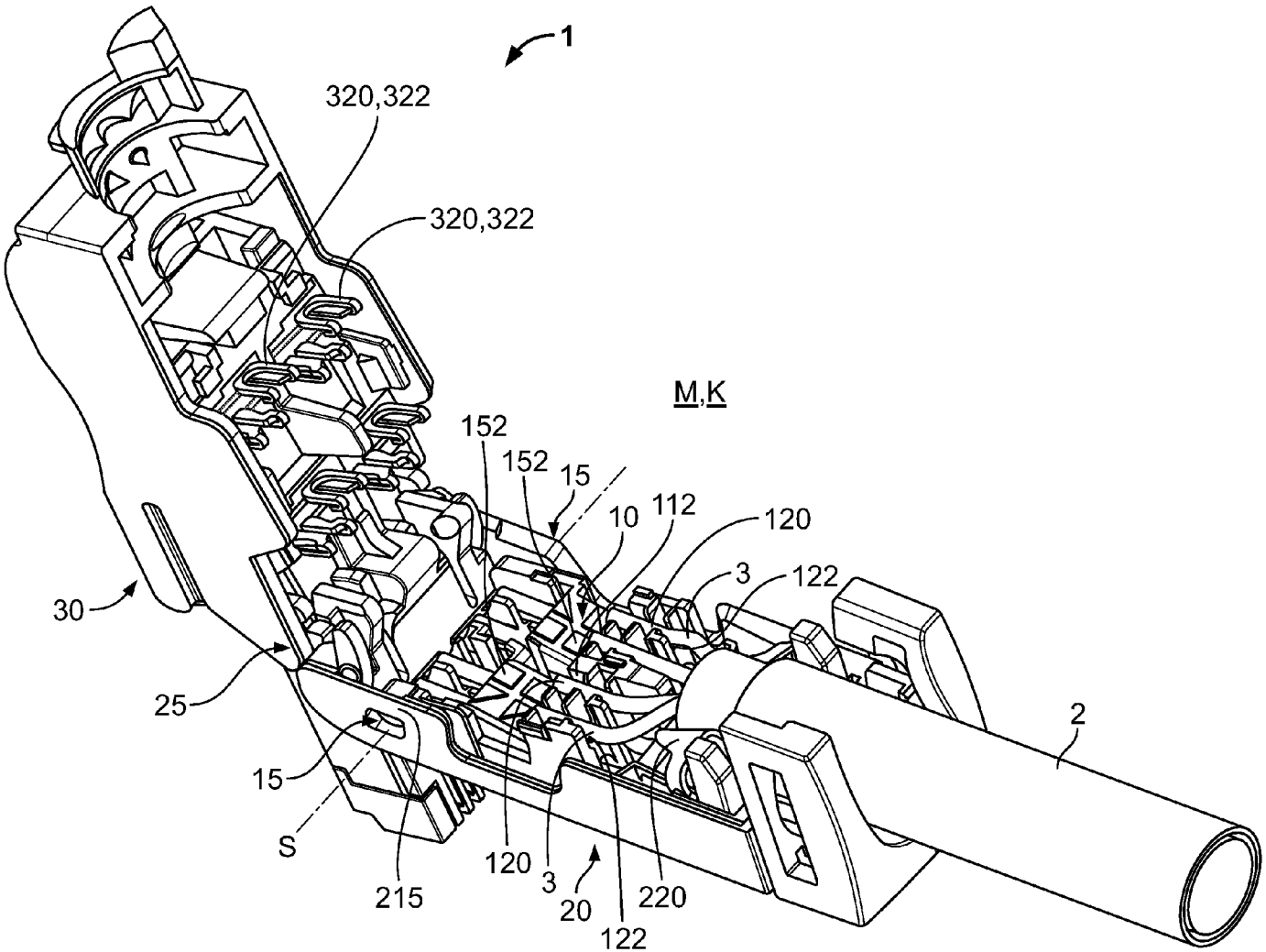
FIG. 7 is a perspective view during fitting of the cable from FIGS. 4 and 5 on/in the plug connector according to FIG. 1, the strand guide being shown in the fitting position and the contact position.
Figure 8:
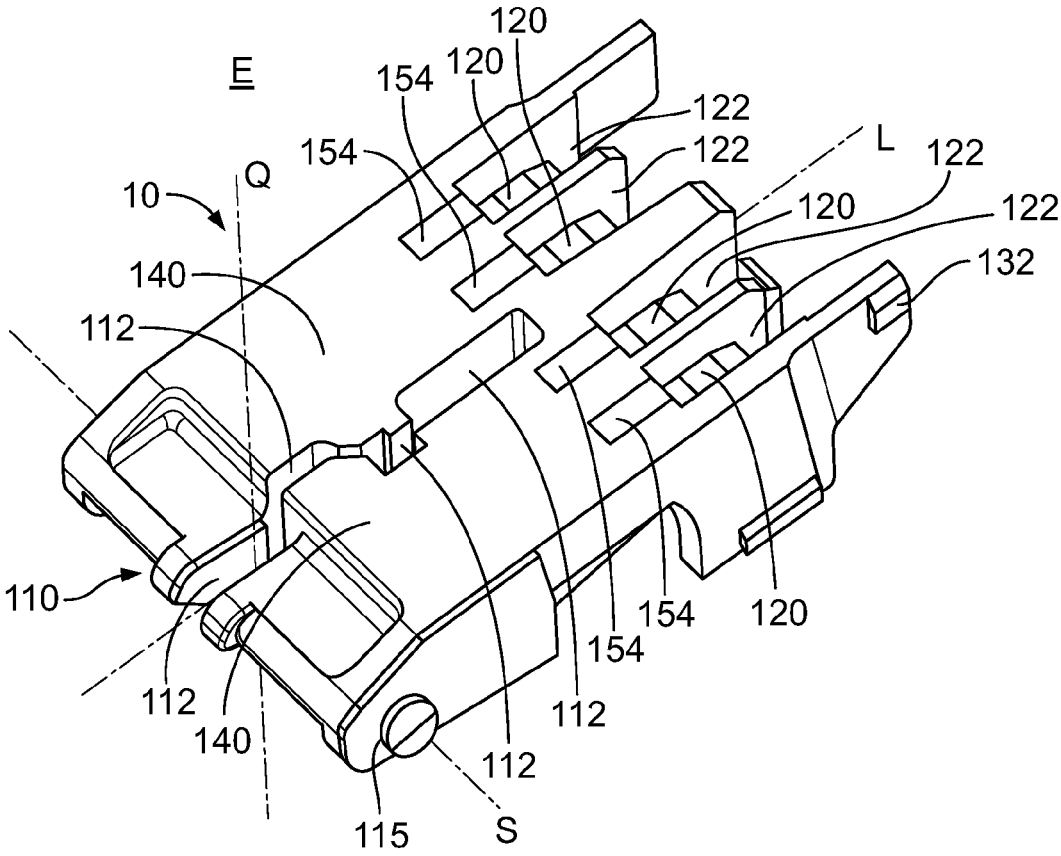
FIG. 8 is a three-dimensional plan view of a singled-out strand guide according to FIG. 4.
Figure 9:
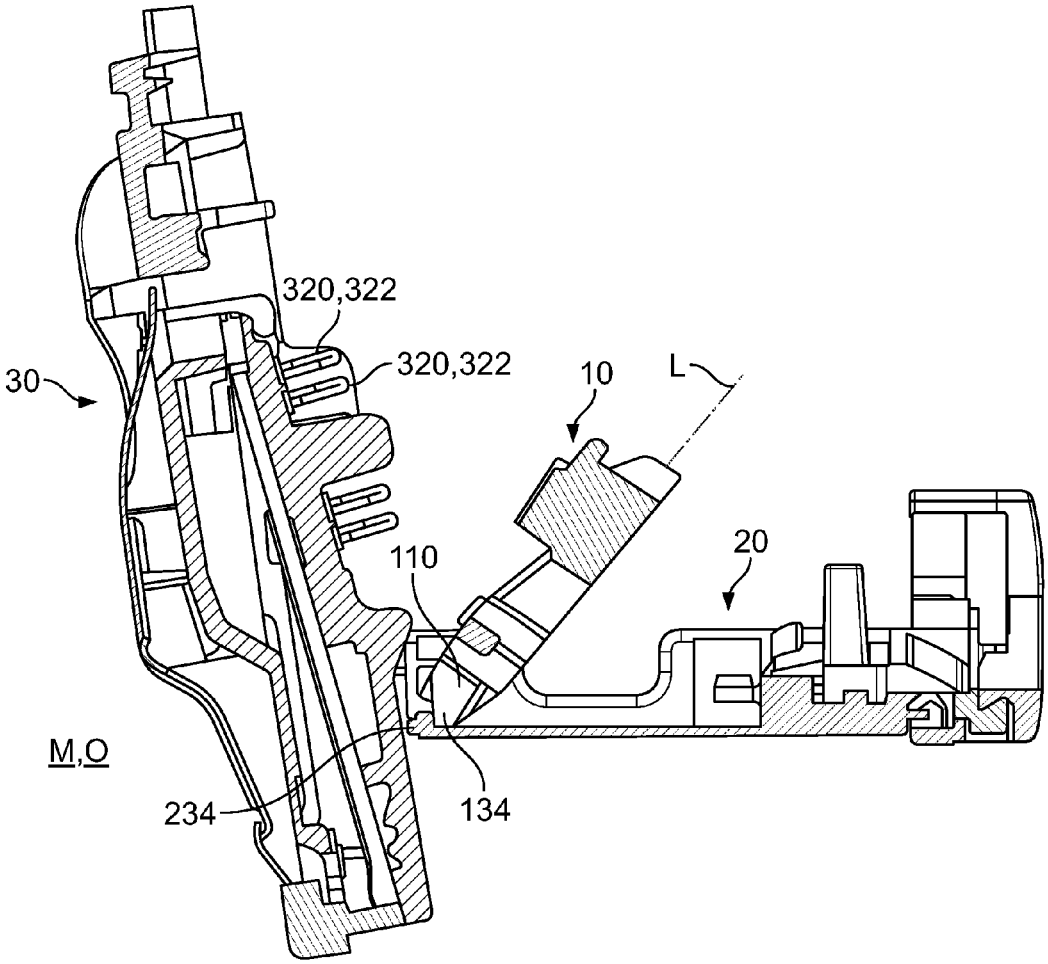
FIG. 9 is a cut-away side view of the plug connector from FIG. 1, the strand guide being shown in the fitting position and the open position.

As a result of downward pivoting of the strand guide 10 together with the cable 20, the strand guide 10 returns to the contact position K in which the longitudinal end portions of the strands 3 can be electrically contacted by the housing upper part 30; FIG. 7 shows this. In this case, the strand guide 10 is, again, locked to the housing lower part 20 or the strain relief metal sheet 220. The strain relief metal sheet 220 has preferably also the function of an electromagnetic shielding metal sheet, the strain relief metal sheet 220 electrically contacting a shielding of the cable 2; this may be seen to be merely indicated in FIG. 7.

As the housing upper part 30 pivots downward onto the housing lower part 20 (not shown in the drawings), the insulation displacement contacts 322 dip into the recesses in the strand guide 10 and as a result cut open the electrical insulations of the strands 3, the metallic strands 3 located therebelow being electrically contacted. That is to say, in accordance with the invention, electrical contacting is carried out by way of pivoting of the insulation displacement contacts 322. An electrical connection of the insulation displacement contacts 322 to the electrical contacts 324, which in the present case are embodied as pin contacts 324, establishes a correct electrical connection between the strands 3 of the cable 2 and the pin contacts 324.

Figure 10:
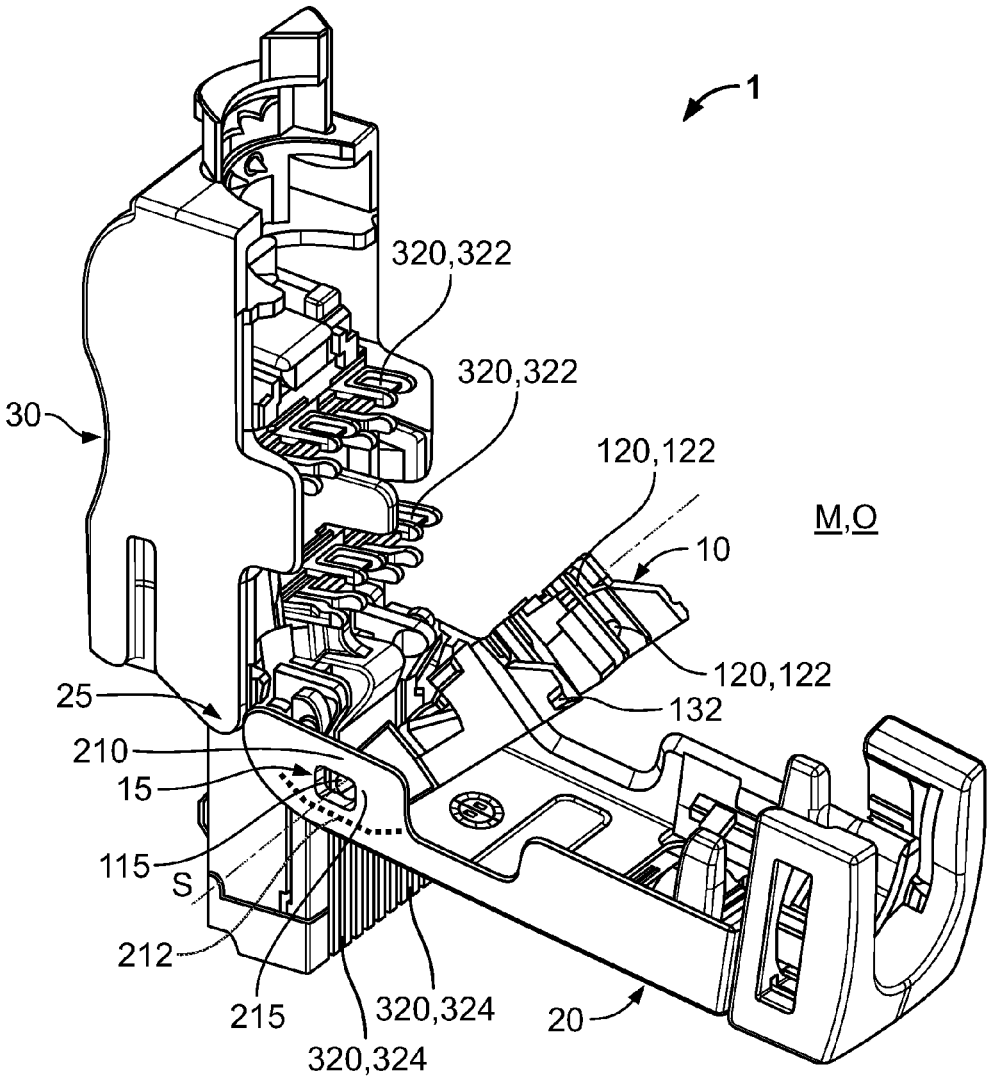
FIG. 10 is a perspective view onto a second embodiment of an opened electrical plug connector according to the invention with a strand guide according to the invention in a fitting position and an open position.

FIG. 10 shows the second embodiment of the invention, in which the movability of a bearing partner 215 is provided in a different way. The bearing guide 10 has in this case preferably no release means 112, i.e. preferably no spring slot 112. Instead, this function is performed by a single bearing shell or both bearing shells 215 of the housing lower part 20.

That is to say, in the second embodiment of the invention, the bearing shell 215 in question is cut free in such a way that it is able to move in relation to the housing lower part 20 substantially in a direction of the pivot axis S. For this purpose, at least one bearing shell 215 is provided on a spring tab 210 which is provided so as to be set apart, via the release means 212 which is embodied in particular as a spring gap 212, from the housing lower part 20 and movable. In addition, the electrical plug connector 1 is constructed like that described above.

Very generally, it is preferable in pivot bearings 15 for the bearing partner which can be moved away—in the first embodiment the two bearing journals 115 of the strand guide 10 and in the second embodiment the bearing shell 215 of the spring tab 210—to be moved away, in the direction of the pivot axis S, from the respective other bearing partner—in the first embodiment the two bearing shells 215 of the housing lower part 20 and in the second embodiment a bearing journal 115 of the strand guide 10.

What is claimed is:

1. Electrical plug connector comprising:

a housing;

an electrical wire supported by the housing;

an insulation displacement member coupled to the housing and configured to be operably coupled to the electrical wire;

a strand guide which is removably coupled to the housing, the strand guide being coupled to the housing in a fitting position and being removed from the housing in a removal position; and a release mechanism which can be used to separate the strand guide from the housing, the strand guide being configured to support an electrical cable when in the fitting position and the removal position, and the strand guide being configured to cooperate with the insulation displacement member to electrically couple the electrical cable with the electrical wire.

2. Electrical plug connector according to claim 1, wherein the strand guide is provided in the fitting position so as to be movable on but securely connected to the housing, and starting from the fitting position, the strand guide can be detached from the housing by actuating the release mechanism for the removal position.

3. Electrical plug connector according to claim 1, wherein the strand guide is mounted on the housing so as to be able to pivot via an arrangement of bearings.

4. Electrical plug connector according to claim 3, wherein one bearing partner of the arrangement of bearings is provided on the strand guide or the housing so as to be able to move by means of the release mechanism in such a way that this bearing partner can be moved away from the respective other bearing partner.

5. Electrical plug connector according to claim 4, wherein the release mechanism is a spring slot by which the one bearing partner of the arrangement of bearings can be moved away from the respective other bearing partner.

6. Electrical plug connector according to claim 4, wherein the bearing partner which can be moved away can be moved away from the respective other bearing partner substantially linearly or on a comparatively large circular path.

7. Electrical plug connector according to claim 5, wherein by means of the spring slot a bearing journal or a bearing shell of the arrangement of bearings can be moved away from a bearing shell corresponding thereto or a bearing journal corresponding thereto.

8. Electrical plug connector according to claim 5, wherein the spring slot extends, starting from a bearing head of the strand guide, into the strand guide in a longitudinal direction thereof.

9. Electrical plug connector according to claim 1, wherein the strand guide is locked to strain relief metal sheet or the housing, in a contact position in which the electrical cable can be electrically contacted by the electrical wire.

10. Electrical plug connector according to claim 9, wherein the strand guide is locked to the strain relief metal sheet or the housing in an open position in which the strand guide is moved out of its contact position.

11. Manufactured electrical cable with an electrical plug connector according to claim 1.

12. Electrical or electronic apparatus or component, with an electrical plug connector according to claim 1 or a manufactured electrical cable according to claim 11.

13. An electrical plug connector comprising:

a housing having an upper portion and a lower portion, one of the upper portion and the lower portion being configured to receive an electrical cable, and the other of the upper portion and lower portion being coupled to an electrical line, the housing being configured to operably couple the electrical line to a portion of the electrical cable;

a strand guide being configured to couple with the housing and support a portion of the electrical cable; and a release mechanism positioned on one of the strand guide and the housing and configured to move the strand guide.

14. The electrical plug connector of claim 13, wherein the strand guide includes contact members configured to receive an electrical strand of the electrical cable, the contact members being positioned in a plurality of rows.

15. The electrical plug connector of claim 13, wherein the strand guide includes a coding mechanism indicative of a condition of the electrical cable.

16. The electrical plug connector of claim 13, wherein the release mechanism includes a spring member and a plurality of bearing journals.

17. An electrical plug connector comprising:

a housing having an upper portion and a lower portion, the upper portion being pivotably coupled to the lower portion;

at least one insulation displacement contact coupled to the housing; and a strand guide configured to be coupled to the lower portion of the housing, the strand guide being movable between an open position and a contact position, and the strand guide being coupled with the lower portion of the housing in the open and contact positions, the strand guide being movable relative to the lower portion to move to the open position, and the strand guide being movable with the lower portion of the housing when in the contact position, the strand guide being configured to support an electrical cable and operably couple a portion of the electrical cable to the at least one insulation displacement contact.

18. The electrical plug connector of claim 17, wherein the upper and lower portions of the housing are pivotable about a first pivot axis, and the strand guide is pivotable about a second pivot axis, the first pivot axis is spaced apart from the second pivot axis.

19. The electrical plug connector of claim 17, further comprising a plurality of insulation displacement contacts, wherein each of the insulation displacement contacts is operably coupled to an electrical line and is operably coupled to an electrical strand of the electrical cable, the electrical strands are supported on the strand guide in a staggered arrangement.

20. The electrical plug connector of claim 17, further comprising bearing members to move the strand guide relative to the lower portion of the housing.

* * * * *